US010283294B2

(12) United States Patent
I

(10) Patent No.: US 10,283,294 B2
(45) Date of Patent: May 7, 2019

(54) METHOD OF PLURAL CONDUCTIVE SLOTS SHARING AN OVERHEATING DESTRUCTIVE FIXING ELEMENT

(71) Applicant: Green Idea Tech Inc., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 168 days.

(21) Appl. No.: 15/431,050

(22) Filed: Feb. 13, 2017

(65) Prior Publication Data

US 2017/0373446 A1 Dec. 28, 2017

Related U.S. Application Data

(62) Division of application No. 15/195,286, filed on Jun. 28, 2016, now Pat. No. 9,698,542.

(51) Int. Cl.

| | |
|---|---|
| ***H01H 37/32*** | (2006.01) |
| ***H01R 13/713*** | (2006.01) |
| *H01R 25/00* | (2006.01) |

(52) U.S. Cl.

CPC ..... *H01H 37/32* (2013.01); *H01R 13/7137* (2013.01); *H01R 25/003* (2013.01)

(58) Field of Classification Search

CPC ..... H01H 35/006; H01H 37/00; H01T 4/04; H01T 4/06

See application file for complete search history.

(56) References Cited

U.S. PATENT DOCUMENTS 9,257,798 B2 2/2016 Wang

FOREIGN PATENT DOCUMENTS

| | | | |
|---|---|---|---|
| CN | 1985104220 A | * | 11/1986 |
| TW | 208384 | | 6/1993 |
| TW | 262168 | | 11/1995 |
| TW | 320335 | | 11/1997 |
| TW | 367091 | | 8/1999 |
| TW | 540811 | | 7/2003 |
| TW | M 433670 | | 7/2012 |
| TW | I371053 B | | 8/2012 |

* cited by examiner

*Primary Examiner* — Carl J Arbes

(74) *Attorney, Agent, or Firm* — Muncy, Geissler, Olds & Lowe, P.C.

(57) ABSTRACT

A method of plural conductive slots sharing an overheating destructive fixing element is disclosed, including a first conductive element, a second conductive element and an overheating destructive fixing element. The first conductive element includes a front end, a rear end, plural conductive slots, a connection portion and a contact portion. The conductive slots include a front end conductive slot and a rear end conductive slot, between which a control section is defined. The connection portion is disposed on the control section, and the contact portion connects the connection portion. The second conductive element contacts the contact portion by the overheating destructive fixing element, allowing the plural conductive slots to share the overheating destructive fixing element. Furthermore, when any one conductive slot reaches each own limiting working temperature respectively, the overheating destructive fixing element is destructed by reaching a pre-determined temperature.

1 Claim, 10 Drawing Sheets

METHOD OF PLURAL CONDUCTIVE SLOTS SHARING AN OVERHEATING DESTRUCTIVE FIXING ELEMENT

CROSS-REFERENCE TO RELATED APPLICATION

This application is a Divisional of co-pending application Ser. No. 15/195,286 filed on Jun. 28, 2016, for which priority is claimed under 35 U.S.C. § 120, the entire contents of all of which are hereby incorporated by reference.

BACKGROUND OF THE INVENTION a) Field of the Invention

The present invention relates to a method of plural conductive slots sharing an overheating destructive fixing element, and more particularly to a method of plural conductive slots sharing an overheating destructive fixing element, such that when any one conductive slot reaches each own limiting working temperature respectively, the overheating destructive fixing element is destructed by reaching a pre-determined temperature.

b) Description of the Prior Art

To prevent a circuit from issues of current overload, short circuit and overheating, a fuse or an overload protector is usually provided at the circuit. When the temperature of the circuit gets too high or the current gets too large, the fuse affected by the high temperature becomes blown or a bimetal shrapnel of the overload protector becomes disengaged, so as to cause the circuit become open circuit and turned off to ensure electricity safety.

Regarding the prior art of a fuse structure, for example, the Taiwan Patent No. I371053 discloses a "Thermal Fuse Connecting Structure," which mainly includes two terminals and a meltable metal engaged at the two terminals. In the event of current overload, circuit overheating or an excessively high ambient temperature, the meltable metal is heated to cause a rise in the temperature and becomes molten and broken. As such, the two terminals become disconnected and the circuit then becomes a turn-off state.

However, the patent I371053 at least exists with following shortcomings, including that:

(1) Except for a few metallic elements, such as bismuth, tin, indium and alkali metal, the melting point of most metals is above 300° C.; for example, the melting point is 1084.6° C. for copper and 1535° C. for iron. In the abovementioned patent 1371053, if a metal with the melting point below 300° C. is chosen as the meltable metal, then the bonding strength may not be strong enough that the two terminals cannot be combined stably. In addition, even the bonding strength is strong enough, the price of the meltable metal may be too high.

(2) As the meltable metal is a conductive material, when the meltable metal is molten and broken, if a residue of the meltable metal is stuck on the two terminals, the residue can easily cause miss contact between the two terminals that the circuit cannot be turned off completely. Or, the molten and broken meltable metal can be ejected off by the two terminals that are opened to turn off the circuit, hitting other objects to form miss contact, which results in short circuit. Therefore, it is still dangerous in using the connection structure.

In addition, the U.S. Pat. No. 9,257,798 discloses a "Socket Having Overheating Destructive Limiting Element," wherein every socket can use an insulative limiting element to form an open path. When the temperature of one socket gets too high, the limiting element thereof will be destructed and broken, such that the overheated socket becomes a turn-off state as the conductive plates are opened with respect to each other.

However, in the U.S. Pat. No. 9,257,798, every socket should be installed with a limiting element and thus every socket should be provided with a structure for installing the limiting element. Therefore, the entire volume of the socket cannot be reduced further, and the structure of the socket will be more complex that it is not easy to decrease the fabrication cost.

Furthermore, the Taiwan Utility Model Patent No. M433670 discloses an "Assembly Structure of an Extension Cord Socket with an Overload Protection Switch from Inside to Outside," which includes a rocker-type overload protection switch. The detailed structure of the overload protection switch is disclosed in the Taiwan Utility Model Patent Publication Nos. 540811, 367091, 320335, 262168 and 208384. The overload protection switch is connected electrically with plural electrode plates which are all formed with plural slots. The rocker-type overload protection switch described above becomes a turn-off state when the temperature gets too high by current overload.

However, in the patent M433670, the distance between each slot and the overload protection switch is not the same. Therefore, upon practically using the patent, certain temperature difference exists between each slot and the overload protection switch under the distance effect of heat transfer, and the longer the distance between the slot and the overload protection switch, the larger the temperature difference. Accordingly, when the temperature of a slot at a far end gets too high, the overload protection switch will not be able to operate in time easily to turn off the circuit, which is still not safe enough in using the patent.

SUMMARY OF THE INVENTION

Accordingly, in order to enable plural conductive slots to share an overheating destructive fixing element and to use the slots more safely, a method of plural conductive slots sharing an overheating destructive fixing element is disclosed, wherein the plural conductive slots sharing an overheating destructive fixing element including a first conductive element and a second conductive element. The first conductive element is provided with a front end, a rear end, plural conductive slots, a connection portion and a contact portion. The abovementioned conductive slots are all disposed between the front end and the rear end, wherein the conductive slot closest to the front end is defined as the front end conductive slot, the conductive slot closest to the rear end is defined as the rear end conductive slot, a control section is defined between the front end conductive slot and the rear end conductive slot, the connection portion is disposed on the control section and the contact portion is connected with the connection portion. The second conductive element is in contact with the contact portion by an overheating destructive fixing element which is destructed under a pre-determined temperature, allowing the first conductive element to be opened with respect to the second conductive element by an elastic force; therefore, the abovementioned plural conductive slots can share the overheating destructive fixing element, and when any conductive slot reaches each own limiting working temperature respectively, the overheating destructive fixing element can be destructed by reaching a pre-determined temperature.

Furthermore, the overheating destructive fixing element is made of plastic.

Furthermore, the overheating destructive fixing element is made of a metal combined with plastic.

Furthermore, the first conductive element is a plate formed integrally. The first conductive element includes plural holding portions, and each holding portion is provided with a holding plate and a holding rib. The holding rib is stamped and protruded out of the holding plate to define the abovementioned conductive slot between the holding plate and the holding rib.

Furthermore, the conductive element includes a long edge which connects the front end and the rear end. The connection portion is physically connected with the long edge perpendicularly, and the contact portion is physically connected with the connection portion perpendicularly, enabling the contact portion to be in adjacent to the control section.

Furthermore, the contact portion of the first conductive element and the second conductive element are all provided with a groove. The groove is concaved in from an edge of the first conductive element and an edge of the second conductive element. The groove of the first conductive element is opposite to the groove of the second conductive element, allowing the overheating destructive fixing element to be emplaced in the groove of the first conductive element and the groove of the second conductive element, and to be combined on the first conductive element and the second conductive element.

Furthermore, the present invention includes a seat unit. The seat unit is provided with a holding slot, two first fixing portions and a second fixing portion. The holding slot is used to dispose the abovementioned first conductive element, the abovementioned first fixing portions are used to fix the abovementioned first conductive element, and the abovementioned second fixing element is used to fix the abovementioned second conductive element.

Furthermore, the seat unit includes a notch disposed at a side. The notch is connected with the abovementioned holding slot and is disposed between the two first fixing portions. The contact portion of the first conductive element is provided with two fixing pins, allowing the connection portion and the contact portion of the first conductive element to be extended out of the notch when the first conductive element is installed in the abovementioned holding slot. In addition, the two fixing pins of the first conductive element can be installed respectively at the two fixing portions.

Furthermore, the two fixing portions are provided with a fixing hole and a fixing protrusion, and the second conductive element is provided with a locating pin and a locating hole to latch with the fixing hole and the fixing protrusion, correspondingly.

The abovementioned limiting working temperature is between 80° C. and 300° C., and the abovementioned pre-determined temperature is between 79° C. and 299° C.

The present invention further includes a housing which accommodates and fixes the first conductive element, the second conductive element, and the overheating destructive fixing element. The housing is provided with plural insertion holes at locations corresponding to the locations of the plural conductive slots of the first conductive element.

The present invention discloses a method which enables plural conductive slots to share an overheating destructive fixing element, comprising providing a first conductive element which includes a front end and a rear end; providing plural conductive slots on the first conductive element, including a front end conductive slot in adjacent to the front end and a rear end conductive slot in adjacent to the rear end, with each abovementioned conductive slot defining a limiting working temperature; selecting a heat conduction place between the front end conductive slot and the rear end conductive slot; connecting the second conductive element at the heat conduction place directly or indirectly, and fixing the second conductive element by an overheating destructive fixing element; setting the overheating destructive fixing element to be destructed at a pre-determined temperature, allowing the first conductive element to be opened with respect to the second conductive element; and setting the abovementioned limiting working temperature at 80~300° C., whereas setting the abovementioned pre-determined temperature at 79~299° C.

According to the abovementioned technical features, the following effects can be achieved:

(1) The heat conduction place is disposed specifically between the front end conductive slot and the rear end conductive slot, which achieves the effect of sharing the overheating destructive fixing element among the plural conductive slots. As the heat transmitted to the overheating destructive fixing element is from the heat conduction place between the front end conductive slot and the rear end conductive slot, the distance of heat conduction between each conductive slot and the overheating destructive fixing element will not change too much, so that when each conductive slot reaches each own limiting working temperature respectively, the overheating destructive fixing element can be destructed by reaching the pre-determined temperature, thereby increasing the safety in using the product.

(2) The limiting temperature is set at 80~300° C. Therefore, before any of the plural sockets is deformed or gets fire, the overheating destructive fixing element can be destructed in advance to turn off the circuit, which stops the temperature rise immediately to assure the safety in using the socket.

(3) The overheating destructive fixing element is made of plastic or a metal combined with plastic. Therefore, the overheating destructive fixing element can be assured to have sufficient bonding strength, and the destructive temperature can be controlled at 79~299° C. as the overheating destructive fixing element is made of plastic.

(4) As the overheating destructive fixing element is disposed in the groove of the first conductive element and the groove of the second conductive element, as well as is combined on the first conductive element and the second conductive element, the first conductive element and the second conductive element can be clamped well. On the other hand, the overheating destructive fixing element is ejected off by an elastic force which is uniformly acted on two sides of the overheating destructive fixing element, allowing the first conductive element to be actually opened with respect to the second conductive element to turn off the circuit.

(5) The first conductive element and the second conductive element can be all installed on a same seat unit, which improves the convenience in assembling the product.

(6) The contact portion of the first conductive element is extended out of the seat unit, which facilitates installing and fixing the overheating destructive fixing element.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of an assembly and method of plural conductive slots sharing an overheating destructive fixing element can be clearly disclosed in the following embodiments.

Figure 1:
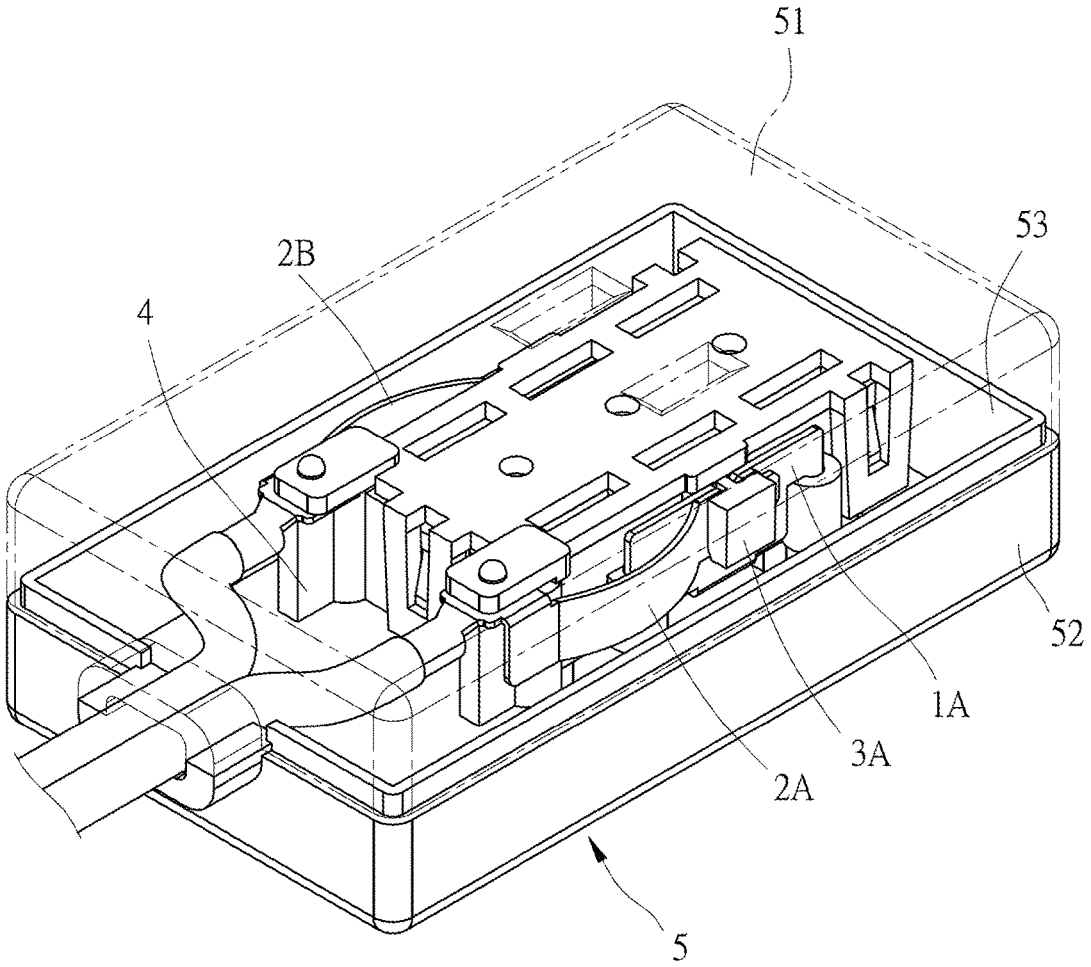
FIG. 1 shows a three-dimensional schematic view of appearance of a first embodiment of the present invention.
Figure 2:
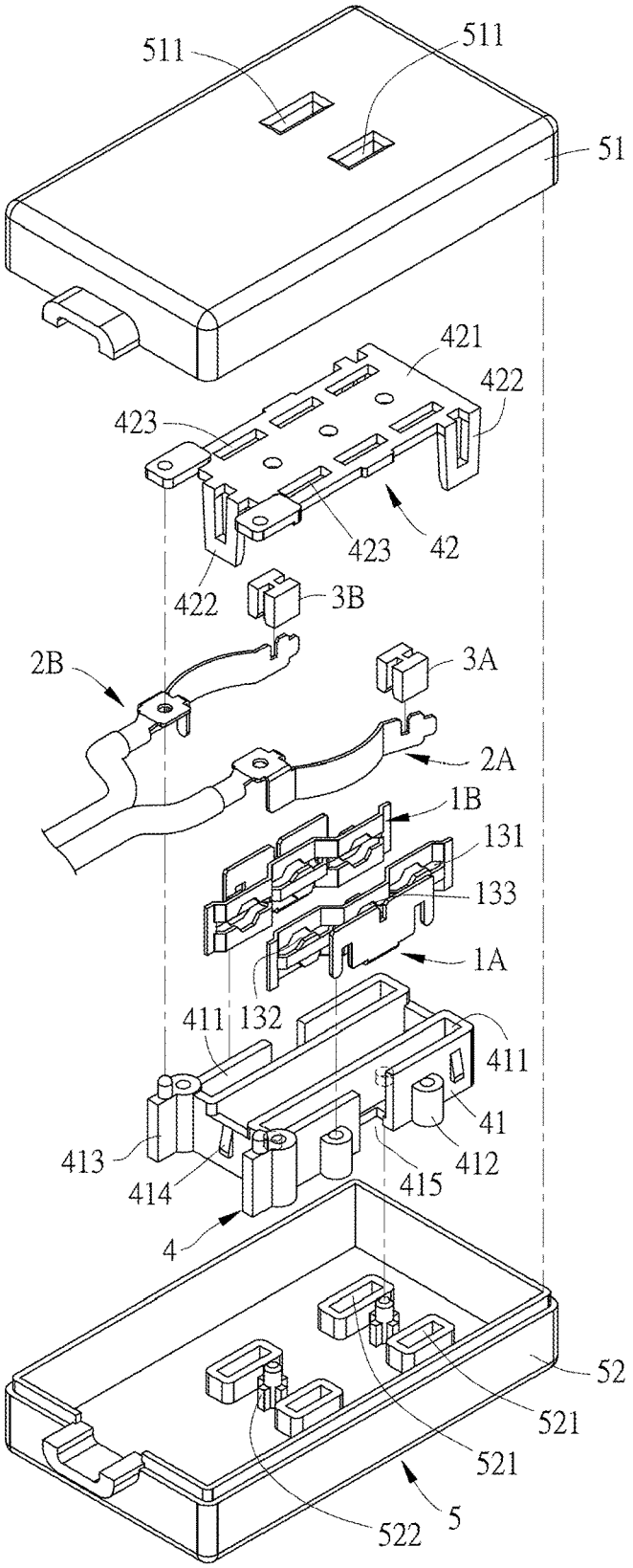
FIG. 2 shows a three-dimensional exploded view of the first embodiment of the present invention.

First, referring to FIG. 1 and FIG. 2 for an assembly of plural conductive slots sharing an overheating destructive fixing element, according to a first embodiment of the present invention, the assembly in the present embodiment is, but not limited to, an extension cord; for example, the assembly can be an adaptive socket or an expansion socket. The assembly comprises two first conductive elements 1A, 1B, two second conductive elements 2A, 2B, two overheating destructive fixing elements 3A, 3B, a fixing seat 4 and a housing 5. As in the present embodiment, the abovementioned two first conductive elements 1A, 1B, two second conductive elements 2A, 2B and two overheating destructive fixing elements 3A, 3B are all in a pair respectively, and further descriptions will be only based upon the first conductive element 1A, the second conductive element 2A and the overheating destructive fixing element 3A. However, this does not mean that the abovementioned two first conductive elements 1A, 1B, the abovementioned two second conductive elements 2A, 2B, and the abovementioned two overheating destructive fixing elements 3A, 3B should have the same configuration.

Figure 3:
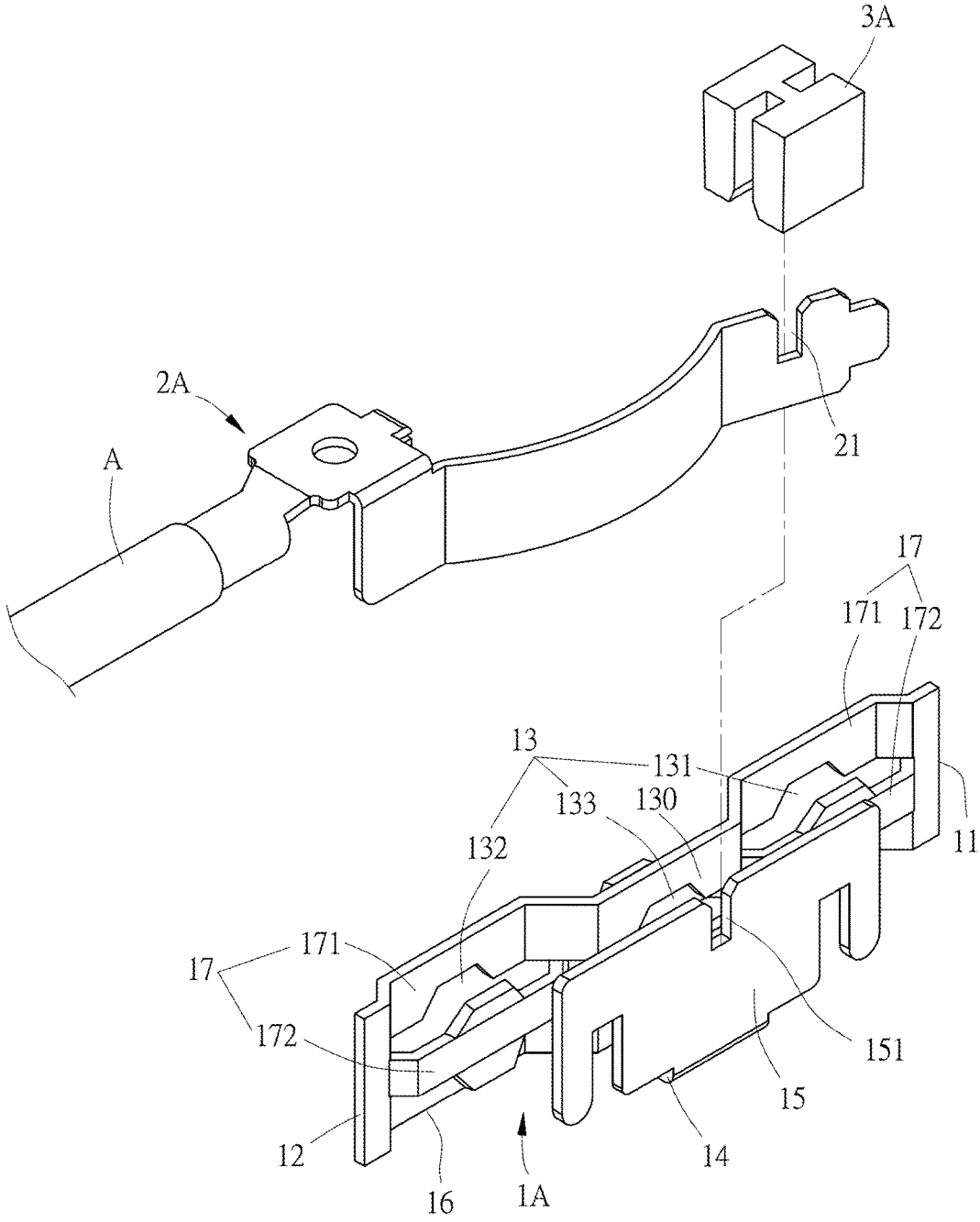
FIG. 3 shows a three-dimensional exploded view of a first conductive element, a second conductive element and an overheating destructive fixing element, according to the first embodiment of the present invention.
Figure 5A:
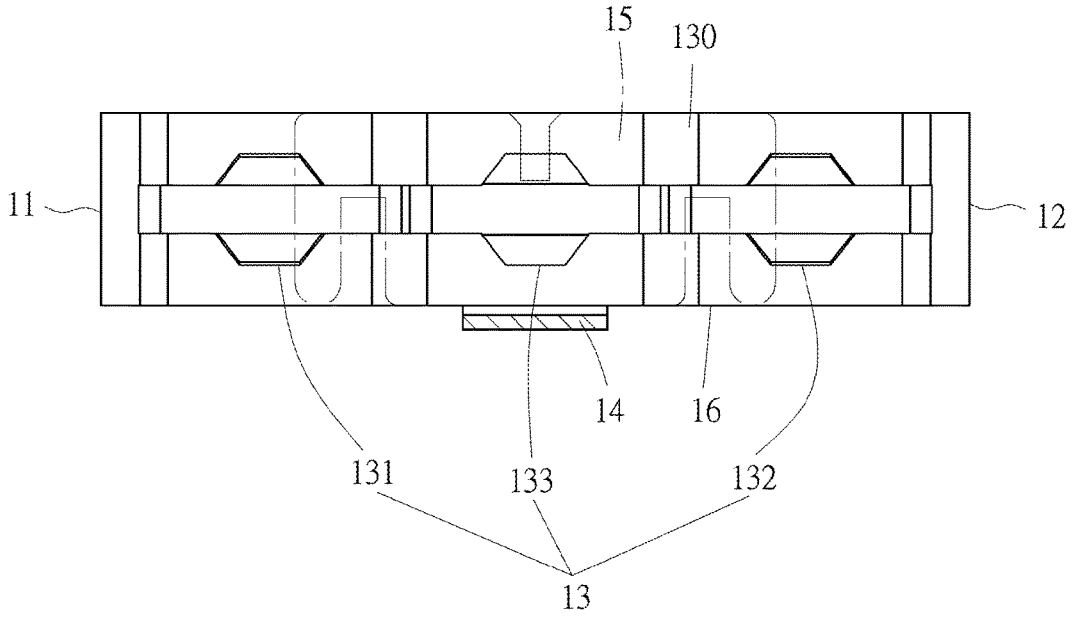
FIG. 5A shows a plan view of the first conductive element according to the first embodiment of the present invention.

Referring to FIG. 3 and FIG. 5A, the first conductive element 1A includes a front end 11, a rear end 12, plural conductive slots 13, a connection portion 14 and a contact portion 15. All the conductive slots 13 of the first conductive element 1A are disposed between the front end 11 and the rear end 12, wherein the conductive slot 13 closest to the front end 11 is defined as a front end conductive slot 131, the conductive slot 13 closest to the rear end 12 is defined as a rear end conductive slot 132, and the conductive slot 13 that is disposed between the front end conductive slot 131 and the rear end conductive slot 132 is defined as a middle conductive slot 133. There can be one middle conductive slot 133 or plural middle conductive slots 133, and there is one middle conductive slot 133 in the present embodiment. A control section 130 is defined between the front end conductive slot 131 and the rear end conductive slot 132, the connection portion 14 is disposed on the control section 130, and the contact portion 15 is connected with the connection portion 14. Specifically, the first conductive element 1A includes a long edge 16 which connects the front end 11 and the rear end 12, the connection portion 14 is physically connected with the long edge 16 perpendicularly, and the contact portion 15 is physically connected with the connection portion 14 perpendicularly.

Figure 5B:
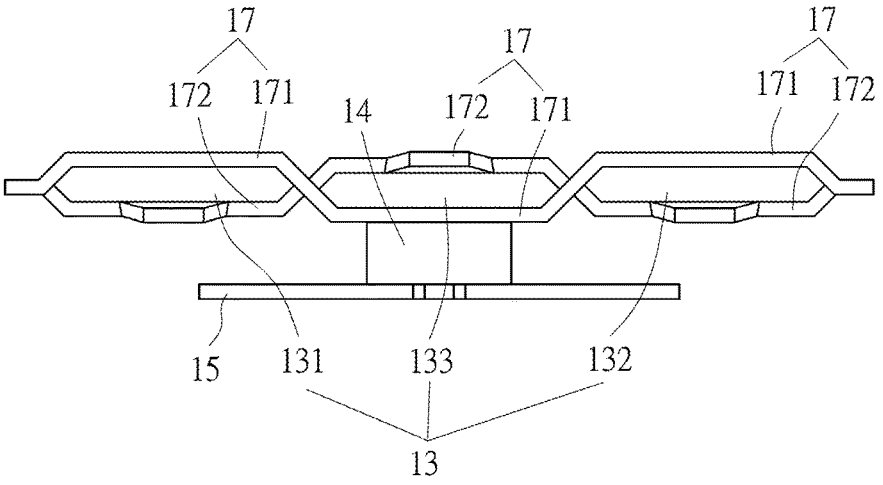
FIG. 5B shows a side view of the first conductive element according to the first embodiment of the present invention.

Referring to FIG. 3 and FIG. 5B, it is preferred that the first conductive element 1A is a plate formed integrally. The first conductive element 1A includes plural holding portions 17, and each holding portion 17 is provided with a holding plate 171 and a holding rib 172. The holding rib 172 is stamped and protruded out of the holding plate 171 to define the abovementioned conductive slot 13 between the holding plate 171 and the holding rib 172. In addition, the connection portion 14 and the contact portion 15 are also formed integrally by bending the plate, such that the first conductive element 1A can be fabricated quickly.

Figure 4:
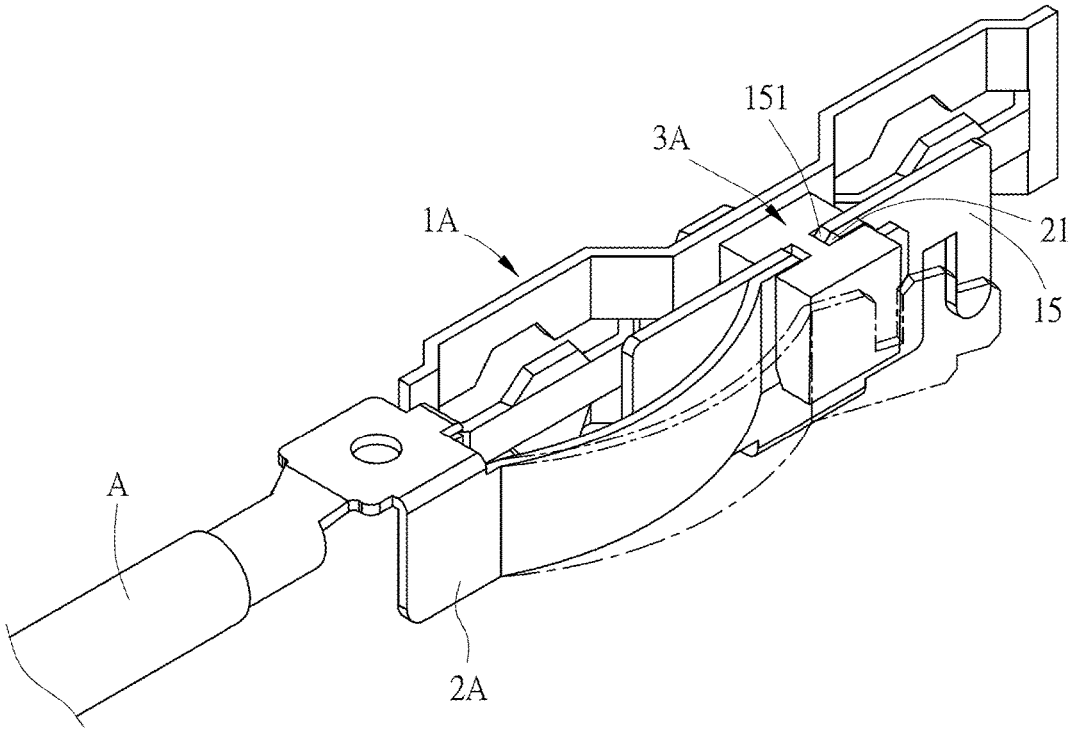
FIG. 4 shows a three-dimensional assembly view of the first conductive element, the second conductive element and the overheating destructive fixing element, according to the first embodiment of the present invention.

Referring to FIG. 3 and FIG. 4, the abovementioned second conductive element 2A is connected electrically with an electric wire A (such as a live wire or a neutral line), and is in contact with the first conductive element 1A by the overheating destructive fixing element 3A. To be more specific, the second conductive element 2A is a spring leaf, and a pre-determined gap is provided between the second conductive element 2A and the contact portion 15 of the first conductive element 1A, such that when the second conductive element 2A is in contact with the contact portion 15 by the overheating destructive fixing element 3A, the second conductive element 2A can be bended to store an elastic force.

Referring to FIG. 3 and FIG. 4, it is preferred that the contact portion 15 of the first conductive element 1A and the second conductive element 2A are all provided with a groove 151, 21. The groove 151, 21 is concaved in from an edge of the contact portion 15 of the first conductive element 1A and an edge of the second conductive element 2A. The groove 151 of the first conductive element 1A is opposite to the groove 21 of the second conductive element 2A, allowing the overheating destructive fixing element 3A to be emplaced in the groove 151 of the first conductive element 1A and the groove 21 of the second conductive element 2A, and to be combined on the first conductive element 1A and the second conductive element 2A.

Figure 4A:
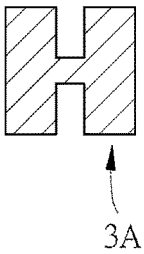
FIG. 4A shows a first cutaway view of the overheating destructive fixing element according to the first embodiment of the present invention, illustrating that the overheating destructive fixing element is made of plastic.
Figure 4B:
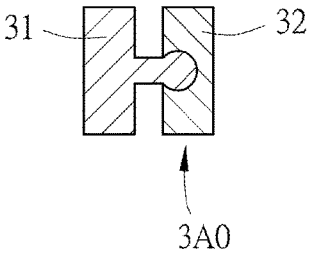
FIG. 4B shows a second cutaway view of the overheating destructive fixing element according to the first embodiment of the present invention, illustrating that the overheating destructive fixing element is made of a metal combined with plastic.

Referring to FIG. 4A, the abovementioned overheating destructive fixing element 3A can be made integrally of plastic and is destructed at a pre-determined temperature (e.g., 79~299° C.). Referring to FIG. 4B, the overheating destructive fixing element 3A0 can be also made of a metal combined with plastic, such as a metal element 31 combined with a plastic element 32, such that the overheating destructive fixing element 3A0 can be actually destructed at the pre-determined temperature due to the effect of a good thermal conductivity and thermal expansion of the metal.

Referring to FIG. 2 again, the fixing seat 4 includes a seat unit 41 and a cover unit 42, wherein the seat unit 41 is provided with two holding slots 411, plural first fixing portions 412, plural second fixing portions 413 and plural third fixing portions 414. The abovementioned two holding slots 411 are used to dispose the first conductive element 1A, 1B respectively. The abovementioned first fixing portions 412 are used to fix the first conductive elements 1A, 1B, the abovementioned second fixing portions 413 are used to fix the second conductive elements 2A, 2B, and the abovementioned third fixing portions 414 are used to fix the cover unit 42. The cover unit 42 includes a shield portion 421 and plural inlay ribs 422, the shield portion 421 is provided with plural through-holes 423 to shield the abovementioned first conductive element 1A, 1B, and the inlay ribs 422 are latched into the third fixing portions 414 of the seat unit 41.

Figure 6:
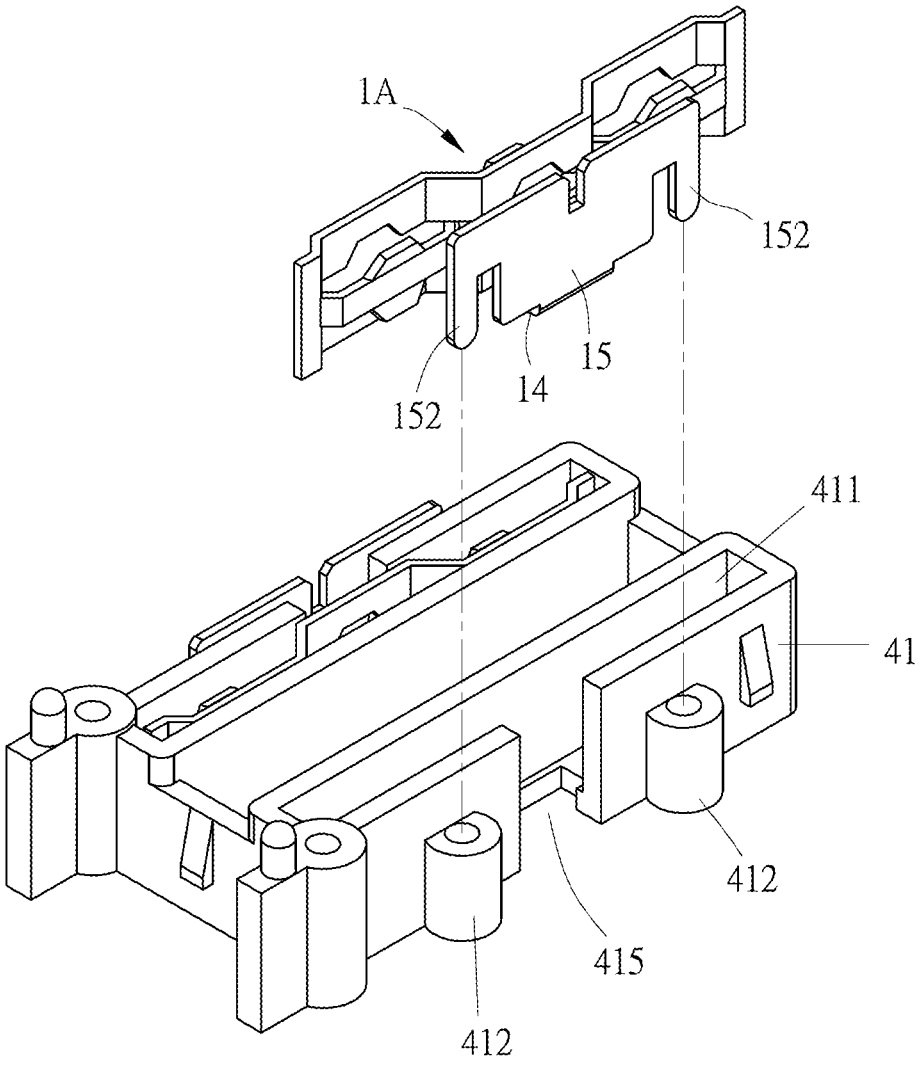
FIG. 6 shows a three-dimensional exploded view of the first conductive element and a seat unit, according to the first embodiment of the present invention.
Figure 7:
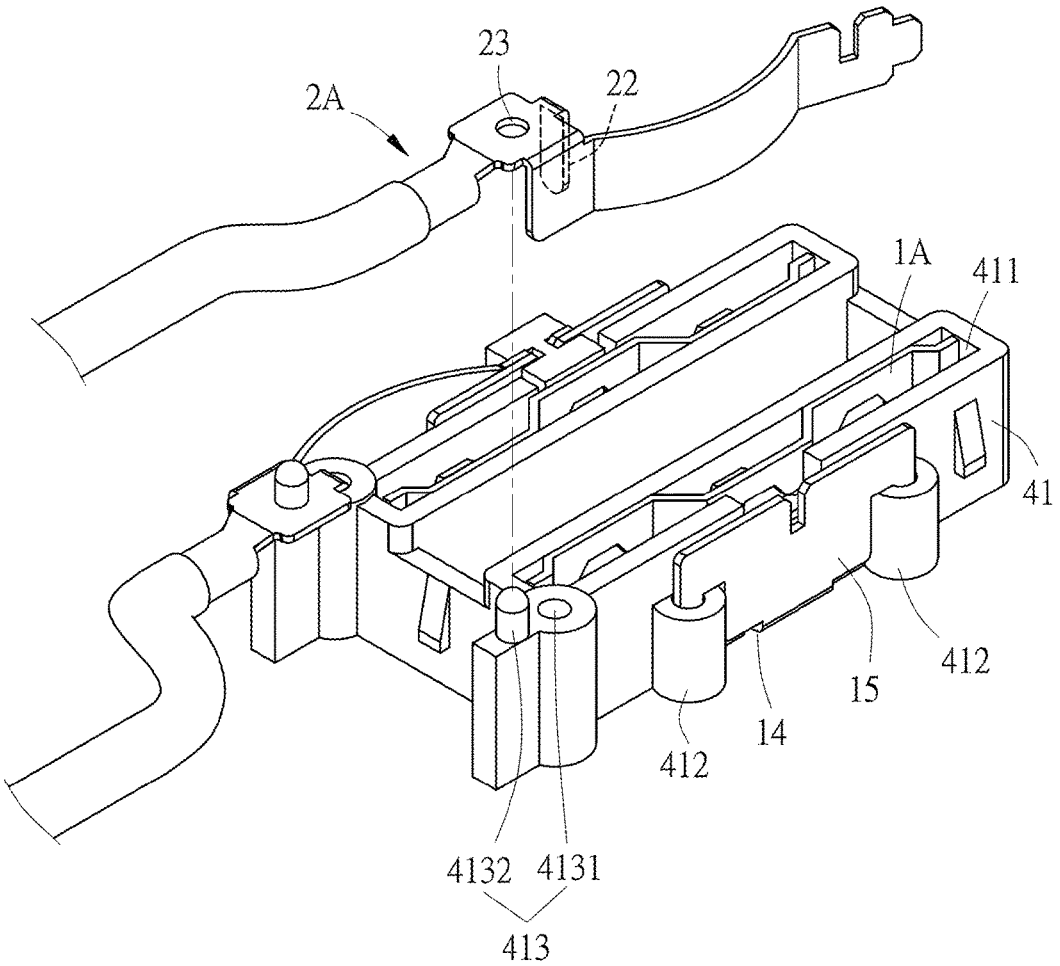
FIG. 7 shows a three-dimensional exploded view of the second conductive element and the seat unit, according to the first embodiment of the present invention.

Referring to FIG. 6, to be more specific, two sides of the seat unit 41 are all provided with two first fixing portions 412 and a notch 415. The abovementioned first fixing portion 412 is a combining pillar and the notch 415 connects the abovementioned holding slot 411 and is disposed between the abovementioned two first fixing portions 412. In addition, the contact portion 15 of the first conductive element 1A is provided with two fixing pins 152, such that when the first conductive element 1A is installed in the abovementioned holding slot 411, the connection portion 14 and the contact portion 15 of the first conductive element 1A can correspond to the notch 415. The two fixing pins 152 of the first conductive element 1A can be installed respectively at the abovementioned two first fixing portions 412, allowing the first conductive element 1A to be fixed stably at the seat unit 41. Referring to FIG. 7, the abovementioned two second fixing portions 413 are provided with a fixing hole 4131 and a fixing protrusion 4132; whereas, the second conductive element 2A is provided correspondingly with a locating pin 22 and a locating hole 23 which can be latched with the fixing hole 4131 and the fixing protrusion 4132, respectively.

Referring to FIG. 1 and FIG. 2 again, the housing 5 includes a first shell element 51 and a second shell element 52 which are covered together. A holding space 53 is defined between the first shell element 51 and the second shell element 52 to accommodate the abovementioned first conductive elements 1A, 1B, the abovementioned second conductive elements 2A, 2B, the abovementioned overheating destructive fixing elements 3A, 3B and the abovementioned fixing seat 4. The first shell element 51 includes a pair of first insertion hole 511 corresponding to the through-holes 423 of the cover unit 42. The pair of the first insertion hole 511 corresponds to the middle conductive slot 133. The second shell element 52 includes two pairs of second insertion hole 521 and plural installation portions 522. The two pairs of the second insertion hole 521 correspond respectively to the front end conductive slot 131 and the rear end conductive slot 132. The installation portions 522 provide for installing and fixing the seat unit 4. In addition to the embodiments shown in FIG. 1 and FIG. 2, other equivalent housings can be used to accommodate and fix a pair of the first conductive element, a pair of the second conductive element, and a pair of the overheating destructive fixing element, with plural insertion holes being disposed on the housing and the locations of the insertion holes corresponding to the locations of the plural conductive slots on the first conductive element. These are all feasible embodiments of the present invention.

Figure 8:
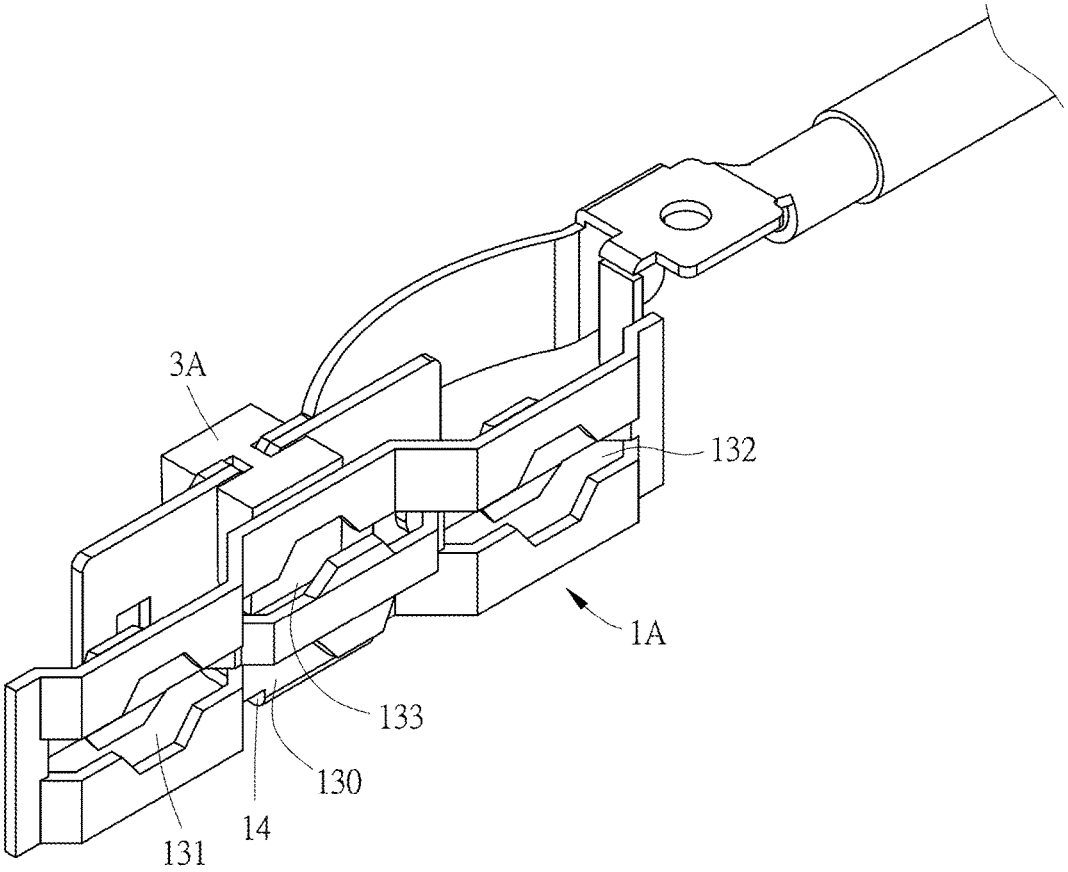
FIG. 8 shows a three-dimensional view of the first embodiment of the present invention, along another view angle.
Figure 9:
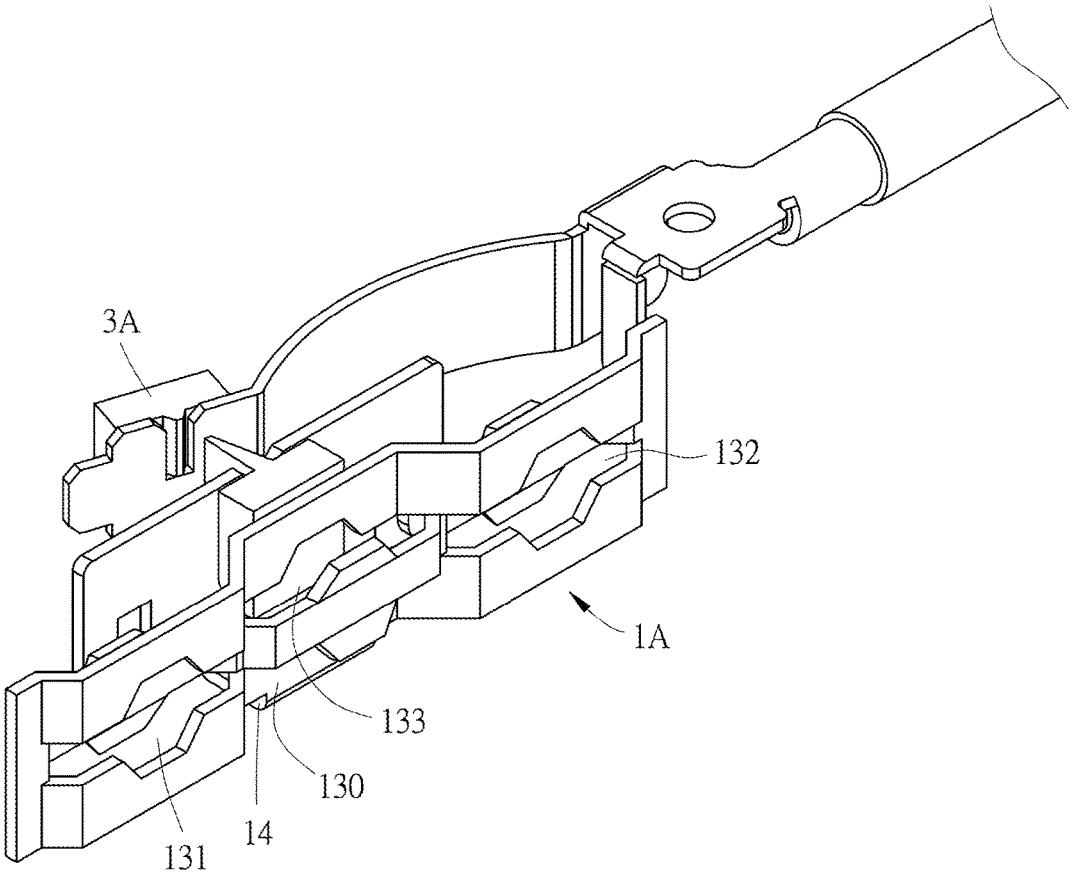
FIG. 9 shows a schematic view of a state of that the overheating destructive fixing element is destructed, according to the first embodiment of the present invention.

Referring to FIG. 8 and FIG. 9 for the condition in use, when the first conductive element 1A is disposed at the front end conductive slot 131, the rear end conductive slot 132 or the middle conductive slot 133, and is heated up as the load is too large or the contact is bad, the heat will be transmitted to the overheating destructive fixing element 3A from the connection portion 14 of the first conductive element 1A, at the control section 130. When the temperature continues to rise up and reaches a limiting working temperature of the front end conductive slot 131, the rear end conductive slot 132 or the middle conductive slot 133, the overheating destructive fixing element 3A will be destructed by reaching a pre-determined temperature. As the heat from the temperature rise in the front end conductive slot 131, the rear end conductive slot 132 and the middle conductive slot 133 is transmitted to the overheating destructive fixing element 3A from the connection portion 14 of the first conductive element 1A at the control section 130, the distance of heat conduction from the front end conductive slot 131, the rear end conductive slot 132 or the middle conductive slot 133 to the overheating destructive fixing element 3A will not differ a lot, such that the overheating destructive fixing element 3A can react in time, which improves the safety in using the product. In the present embodiment, the connection portion 14 is used to transmit any one of the limiting working temperatures of the front end conductive slot 131, the rear end conductive slot 132 and the middle conductive slot 133 to the place where the overheating destructive fixing element 3A is located. In the present embodiment, the place where the connection portion 14 is located is a "heat conduction place" at which the limiting working temperature is transmitted.

Figure 10:
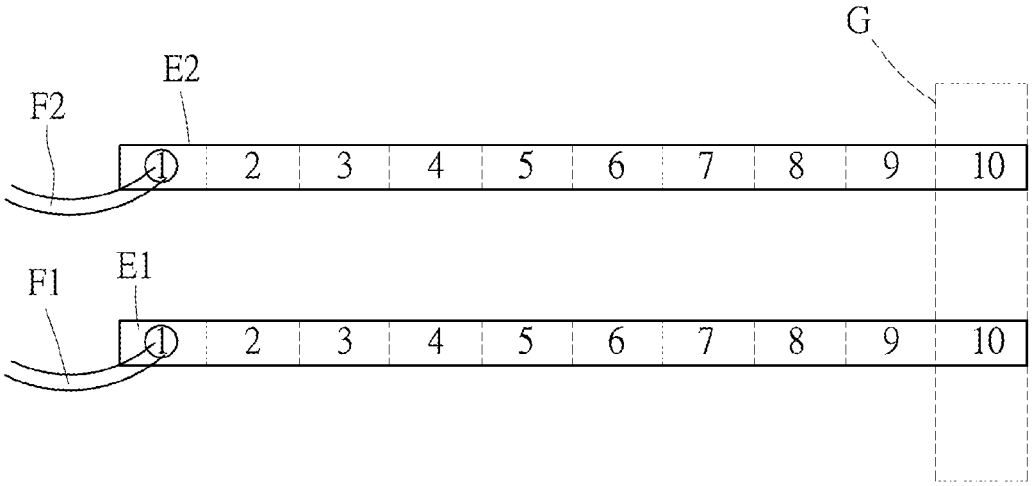
FIG. 10 shows a plan view of an experimental test sample.

Referring to FIG. 10, it shows a schematic view of an experimental test sample. The test sample includes two copper plates E1, E2, with an end of the copper plate E1, E2 being welded with a live wire F1 and a neutral line F2. The length of the copper plates E1, E2 is 100 mm, the width is 5 mm and the thickness is 0.6 mm. In addition, there are 10 test positions disposed orderly along the length of the copper plates E1, E2 by every 10 mm, designated as position 1 to position 10. The experimental test sample is tested under a condition of crossing a load G by two pins in a width of 0.8 mm over position 10 of the two copper plates E1, E2 and then feeding in an electric current and gradually increasing the electric current until the temperature at position 10 reaches 100° C., 200° C. and 300° C. Next, the electric current is kept at that condition, and the temperature at each test position is measured at different times after energizing. The results of test are listed in Table 1, Table 2 and Table 3 respectively.

TABLE 1

(unit: ° C.)

| | Position | | | | | | | | | |
|---|---|---|---|---|---|---|---|---|---|---|
| Time | 1 | 2 | 3 | 4 | 5 | 6 | 7 | 8 | 9 | 10 |
| 25 min. | 51.8 | 51.8 | 52.5 | 57.5 | 57.0 | 67.8 | 75.3 | 78.7 | 85.9 | 99.6 |
| 30 min. | 53.3 | 53.7 | 54.4 | 59.7 | 59.6 | 70.5 | 78.2 | 81.8 | 88.9 | 102.3 |
| 40 min. | 52.6 | 53.5 | 54.5 | 59.7 | 59.7 | 70.3 | 77.9 | 81.3 | 87.3 | 99.8 |
| 50 min. | 53.1 | 54.9 | 55.1 | 60.4 | 60.6 | 71.6 | 78.4 | 82.0 | 88.2 | 100.3 |
| 60 min. | 53.7 | 55.6 | 55.8 | 61.2 | 61.3 | 72.2 | 79.3 | 82.9 | 88.8 | 101.2 |

It can be shown in Table 1 that if the "heat conduction place" is set at position 7, and position 10 represents a socket which connects a load at a same time. When the limiting working temperature at position 10 is set at 99.6~102.3° C., then the pre-determined temperature of the overheating destructive fixing element at position 7 should be between 75.3° C. and 79.3° C. According to Table 1, if the "heat conduction place" is set between position 1 and position 10, then it can effectively take care of any position in position 1 to position 10, such that the limiting working temperature at any position in position 1 to position 10 will not be too different from the pre-determined temperature of the overheating destructive fixing element. This is one of the primary features of the present invention.

TABLE 2

(unit: ° C.)

| | Position | | | | | | | | | |
|---|---|---|---|---|---|---|---|---|---|---|
| Time | 1 | 2 | 3 | 4 | 5 | 6 | 7 | 8 | 9 | 10 |
| 25 min. | 110.7 | 121.9 | 130.9 | 141.5 | 151.8 | 161.5 | 171.2 | 181.7 | 191.1 | 202.9 |
| 30 min. | 110.9 | 121.9 | 131.2 | 141.9 | 152.0 | 161.9 | 172.3 | 182.2 | 191.6 | 202.2 |
| 40 min. | 111.1 | 122.1 | 131.1 | 141.3 | 152.3 | 162.0 | 172.5 | 183.4 | 192.0 | 203.4 |
| 50 min. | 111.5 | 122.4 | 131.6 | 141.8 | 152.0 | 162.5 | 172.9 | 183.5 | 191.9 | 202.1 |
| 60 min. | 111.9 | 122.4 | 131.9 | 142.1 | 152.4 | 162.7 | 173.0 | 183.9 | 191.5 | 201.2 |

It can be shown in Table 2 that when the working temperature at position 10 reaches about 200° C., the "heat conduction place" is set at position 5, and when the working temperature at position 10 is between 202.1° C. and 203.4° C., the temperature difference between position 10 and position 5 will be between 48.8° C. and 51.1° C. depending upon the working time, whereas the temperature difference between position 1 and position 5 will be between 40.5° C. and 41.2° C. depending upon the working time. From Table 2, when the working temperature at position 10 is around 200° C. and if the "heat conduction place" is set between position 5 and position 6, then it can effectively take care of the limiting working temperature at any position in position 1 to position 10, such that the difference between the pre-determined temperature and any limiting working temperature will be no larger than 55° C.

TABLE 3

(unit: ° C.)

| | Position | | | | | | | | | |
|---|---|---|---|---|---|---|---|---|---|---|
| Time | 1 | 2 | 3 | 4 | 5 | 6 | 7 | 8 | 9 | 10 |
| 25 min. | 202.9 | 212.3 | 223.5 | 233.9 | 244.9 | 256.9 | 266.9 | 277.3 | 287.9 | 302.8 |
| 30 min. | 203.5 | 212.9 | 223.9 | 234.4 | 245.1 | 257.0 | 267.2 | 277.2 | 288.1 | 301.7 |
| 40 min. | 203.9 | 213.0 | 224.6 | 234.9 | 245.9 | 254.4 | 267.9 | 277.9 | 288.5 | 302.4 |

Similarly, it can be shown in Table 3 that when the working temperature at position 10 reaches about 300° C. and if the "heat conduction place" is set between position 5 and position 6, then it can also effectively take care of the limiting working temperature at any position in position 1 to position 10, such that the difference between the pre-determined temperature and any limiting working temperature will be no larger than 60° C.

According to Table 1, Table 2 and Table 3, if the place at which the temperature reaches the limiting working temperature is defined as the "limiting working temperature place," then the larger the distance between the "heat conduction place" and the "limiting working temperature place," the larger the temperature difference between the two. Therefore, if the "heat conduction place" is set between position 1 and position 10, then it can effectively take care of any position in position 1 to position 10, such that the difference between the limiting working temperature at any position in position 1 to position 10 and the pre-determined temperature of the overheating destructive fixing element can be kept within a certain range. This is one of the primary features of the present invention. The present invention is applied to an embodiment with more than two sockets. The said sockets share an overheating destructive fixing element and when any one socket gets too hot, the overheating destructive fixing element will be destructed to become a turn-off state. Taking an extension cord socket as an example, if the working temperature exceeds 300° C., the plastic housing or plastic fitting of the extension cord socket will be deformed by melting, which results in a safety concern. Therefore, in terms of the present invention, the abovementioned limiting working temperature is between 80° C. and 300° C., and the destructive temperature of the overheating destructive fixing element, i.e., the abovementioned pre-determined temperature, is between 79° C. and 299° C.

In Table 1, the smallest temperature difference between two neighboring positions is zero; for example, the temperature difference between position 1 and position 2 at 25 min. In other words, for a copper plate in a length of 30 mm, position 1 and position 3 represent a socket respectively, the measurement point of the pre-determined temperature of the overheating destructive fixing element or the heat conduction place is set at position 2, and if the destructive temperature of the overheating destructive fixing element, i.e., the pre-determined temperature, is set at 51.8° C., then the limiting working temperature at position 1 will be 51.8° C. and the limiting working temperature at position 3 will be 52.5° C. It means that for a shorter copper plate, if the "heat conduction place" is set between two sockets, then the difference between the limiting working temperature of each of the two sockets and the pre-determined temperature can be kept at a smallest value.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A method enabling plural conductive slots to share an overheating destructive fixing element, comprising steps of:

a) providing a first conductive element which includes a front end and a rear end;

b) providing plural conductive slots on the first conductive element, including a front end conductive slot in adjacent to the front end and a rear end conductive slot in adjacent to the rear end, with that each conductive slot is defined respectively with a limiting working temperature of each of the plural conductive slots;

c) selecting a heat conduction place between the front end conductive slot and the rear end conductive slot;

d) connecting a second conductive element with the heat conduction place of the first conductive element directly or indirectly, and emplacing an overheating destructive fixing element in a groove of the first conductive element and a groove of the second conductive element, so as to fix the second conductive element on the first conductive element;

e) setting the overheating destructive fixing element to be destructed at a pre-determined temperature, allowing the first conductive element to be opened with respect to the second conductive element by an elastic force; and f) setting the limiting working temperature at 80~300° C. and setting the pre-determined temperature at 79~299° C.

* * * * *